US005392833A

United States Patent [19]

Ohanesian

[11] Patent Number: 5,392,833

[45] Date of Patent: Feb. 28, 1995

[54] VERTICAL BLINDS WITH CURTAIN ATTACHMENT

[76] Inventor: Harout O. Ohanesian, 19012 Clymer St., Northridge, Calif. 91326

[21] Appl. No.: 967,798

[22] Filed: Oct. 28, 1992

[51] Int. Cl.[6] ..... E06B 3/32

[52] U.S. Cl. ..... 160/89; 160/168.1

[58] Field of Search ..... 160/89, 127, 166.1, 160/168.1, 176.1, 113, 115, 178.1, 126; 16/87.4 R, 94 R, 94 D, 95 R, 95 D, 96 R, 96 D

[56] References Cited

U.S. PATENT DOCUMENTS

| | | | |
|---|---|---|---|
| 3,497,905 | 3/1970 | Pflum | 160/126 X |
| 3,851,699 | 12/1974 | Shapiro | 160/168.1 X |
| 3,871,082 | 3/1975 | Pflum | 16/87.4 R X |
| 3,883,924 | 5/1975 | Grabman | 16/94 D |
| 4,011,696 | 3/1977 | Klein | 16/87.4 R X |
| 4,023,235 | 5/1977 | Cohen et al. | 16/94 D |
| 4,546,809 | 10/1985 | Hadfield | 160/126 |
| 5,012,552 | 5/1991 | Wulf | 160/89 X |

*Primary Examiner*—David M. Purol
*Attorney, Agent, or Firm*—Price, Gess & Ubell

[57] ABSTRACT

A curtain is mounted directly to a vertical blind assembly for providing enhanced functionality. Mounting brackets are provided which connect a rear portion of the curtain to individual slat carriers slidably mounted within the housing of the vertical blind assembly. In this manner, lateral movement of the carriers, which causes opening and closing of the vertical blinds, likewise causes an opening and closing of the curtain. The bracket extends a sufficient distance from the housing such that the curtain does not hinder pivoting of the vertical blinds. A number of alternative embodiments are provided in which the curtain is mounted to a second housing, such that the curtain can be opened or closed independently of movement of the vertical slats. The secondary housing is either separate from the housing of the vertical blinds, or is integrally formed as a single Siamese housing.

10 Claims, 4 Drawing Sheets

VERTICAL BLINDS WITH CURTAIN ATTACHMENT

BACKGROUND OF THE INVENTION

1. Field of the Invention

The invention generally relates to vertical blinds and, in particular, to vertical blinds of the type in which individual slats of the vertical blinds are both laterally movable and pivotable.

2. Description of Related Art

Vertical blinds are commonly employed in offices and homes to allow one to conveniently adjust the amount of light entering the room through a window. A typical vertical blind assembly includes a head rail, which mounts above a top horizontal edge of a window, and a plurality of individual vertical slats which hang downwardly from the head rail for blocking light entering through the window. Mechanisms are provided within the head rail for laterally moving the slats and for pivoting the slats. With lateral movement, all of the slats of the vertical blind are simultaneously drawn to one end of the head rail, where the slats are compressed together in a closely-spaced coplanar arrangement. Drawing all slats of the vertical blind assembly to one end of the head rail allows a maximum amount of light to enter the room. When a lesser amount of light is desired, the slats are moved in the direction of an opposing end of the head rail, whereby the slats separate, with individual spacing between the slats increasing, ultimately to a configuration where the slats are generally equally spaced beneath the head rail. To completely darken the room, a second mechanism is employed for rotating each of the individual slats about a respective vertical axis, whereby the slats are moved from a configuration where they are each substantially perpendicular to an axis running along the head rail to a configuration wherein each individual slat is substantially parallel to the axis of the head rail. In the latter configuration, the slats lie closely adjacent with the side edge of one slat overlapping a side edge of an adjacent slat, such that light is substantially completely blocked from entering the room.

A wide range of materials is employed for constructing the vertical assembly, and a wide range of mechanisms is employed for laterally translating the vertical slats and for pivoting the vertical slats.

Thus, the typical vertical blind assembly allows considerable flexibility in regulating the amount of light entering a room by utilizing a combination of the lateral translation of the slats and the vertical pivoting of the slats. Hence, the conventional vertical blind assembly has functional advantages over a curtain. However, a conventional curtain has certain desirable features that a typical vertical blind assembly lacks. For example, a curtain, particularly a translucent curtain, can provide diffuse illumination of a room while still maintaining full privacy. The vertical blind assembly, when closed sufficiently to ensure privacy, does not allow much light to enter the room and, when opened to allow light, does not afford complete privacy. Further, the curtain has the advantage of providing a soft, diffused illumination, whereas sunlight shining through partially opened vertical blinds can yield a stark, high contrast illumination.

Heretofore, the advantages of both a vertical blind and a curtain have not effectively achieved in a single assembly.

SUMMARY OF THE INVENTION

From the foregoing, it can be appreciated that there is a need to provide an assembly which achieves the advantages of both a curtain and a vertical blind, while obviating the disadvantages of each. This object, and other general objects of the invention, are achieved by the provision of a combination vertical blind assembly and curtain, in which the curtain mounts to a laterally movable, but nonpivoting, portion of the vertical blind assembly, whereby the curtain may be opened or closed by laterally moving the slats of the vertical blind, yet where pivoting movement of the slats of the vertical blind is not interfered with by the presence of the curtain.

More particularly, in a vertical blind assembly having a set of vertical slats with each individual vertical slat hanging from a respective stem projecting from a respective carrier held within a housing, and having means for rotating the stems to rotate the slats, and means for moving the carriers laterally within the housing to move the slats laterally, the invention comprises an improvement wherein means are provided for mounting a curtain to the carriers of the blinds, whereby the curtain moves laterally along with the carriers.

The housing is adapted for mounting horizontally above a top horizontal edge of a window. The carriers are slidably mounted within the housing for lateral movement therein. Each individual vertical slat is a narrow, thin, planar slat which mounts to a stem projecting from one of the carriers. Means are provided for sliding the carriers within the housing, and means are provided for pivoting the stems with respect to the carriers, such that the vertical slats pivot about respective vertical axes.

In one embodiment, an attachment member mounts to each of the carriers. The attachment members extend horizontally outwardly from the housing. Means are provided for mounting a curtain to the attachment members, whereby the curtain moves laterally along with the carriers as the carriers are slidably moved within the housing. The attachment members project outwardly from the housing by a sufficient distance such that pivoting movement of the individual slats does not interfere with, and is not interfered by, the presence of the curtain.

In a second embodiment, a second housing is mounted along a front surface of the first housing. The second housing includes a set of carriers, like those in the first housing, which are movable or slidable laterally within the second housing. Attachment members connect the carriers of the second housing to a rear portion of the curtain, whereby the curtain can be opened and closed by moving or sliding the carriers of the second housing. In this manner, movement of the curtain is independent of both the lateral and pivoting movement of the slats, which are attached to the carriers of the first housing. Hence, the slats can be opened, while still keeping the curtain closed, and vice versa. Preferably, the second housing is integrally formed with the first housing. However, the second housing may alternatively be merely attached to the first housing by a suitable attachment mechanism such as a set of brackets.

In yet additional alternative embodiments, the assembly includes a vertically-raisable and lowerable curtain, such as the Austrian type, which mounts to a front portion of the vertical blind housing.

In all embodiments, the invention provides an assembly which achieves the advantages of both a curtain and a vertical blind, while avoiding or minimizing the disadvantages of each. With a combination curtain and vertical blind, the amount of light entering a room can be conveniently selected using the vertical blind assembly, while still maintaining the aesthetic and privacy advantages of a curtain. Further, the stark high contrast illumination caused by direct sunlight entering through a partially opened vertical blind is diffused by the presence of the curtain.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a combination vertical blind assembly and curtain.

Figure 1:
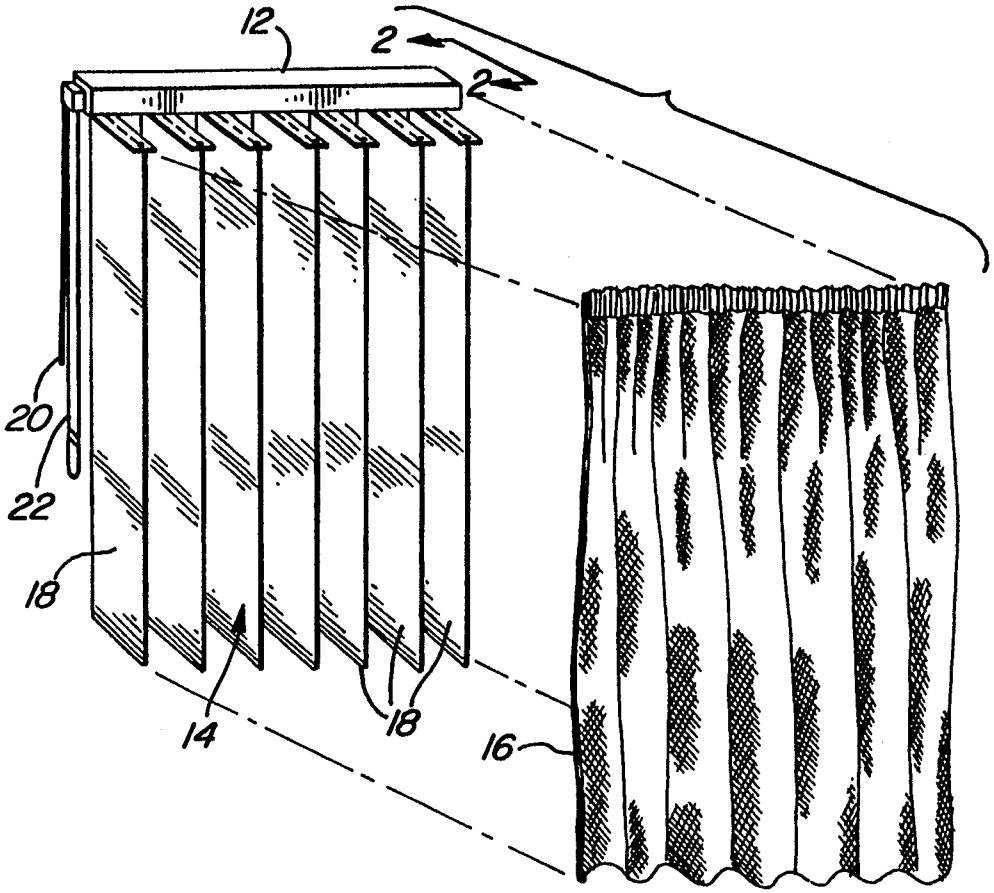
FIG. 1 provides an exploded view of a combination vertical blind assembly and curtain, constructed in accordance with an embodiment of the invention.

Referring to the figures, a preferred embodiment of the invention will now be described. In FIG. 1, a vertical blind assembly 10 is illustrated, which includes a housing 12, a set of vertical blind slats 14, and a curtain 16. Housing 12 is a long, generally rectangular casing, preferably constructed of metal, which is open along a bottom surface. Although not shown, a means is provided for mounting housing 12 to a wall above a top edge of a window, typically in the interior of an office or home.

The set of vertical slats 14 comprises a set of thin vertical slats, individually identified by reference numeral 18. A chain 20 hangs downwardly from one end of housing 12 for allowing pivoting of individual slats 18. In use, one pulls downwardly on either an inner or outer portion of chain 20 to cause slats 18 to pivot simultaneously. In this manner, slats 18 are pivotable from a configuration, as shown, where the slats are generally parallel to each other and perpendicular to an axis extending down the length of housing 12 to a second configuration (not shown) wherein the slats 18 are substantially parallel to the axis of housing 12. The mechanism by which chain 20 causes pivoting movement of individual slats 18 is conventional and will not be described in further detail.

A lateral movement cord 22 also hangs downwardly from one end of housing 12. Lateral movement cord 22 allows one to laterally retract or expand the set of slats 14. By alternately pulling downwardly on either the front or rear portions of cord 22, slats 14 retract into a compact configuration (not shown), wherein the slats are closely bunched or extended to an expanded configuration (shown) where slats 18 are generally equally spaced beneath 12, with a maximum spacing between each slat. Selective use of chain 20 and lateral movement cord 22 allows one to conveniently regulate the amount and quality of light entering the room. The mechanism by which lateral movement cord 22 engages with the set of slats 14 to cause lateral movement of the slats can be entirely conventional and will not be described in further detail.

Figure 2:
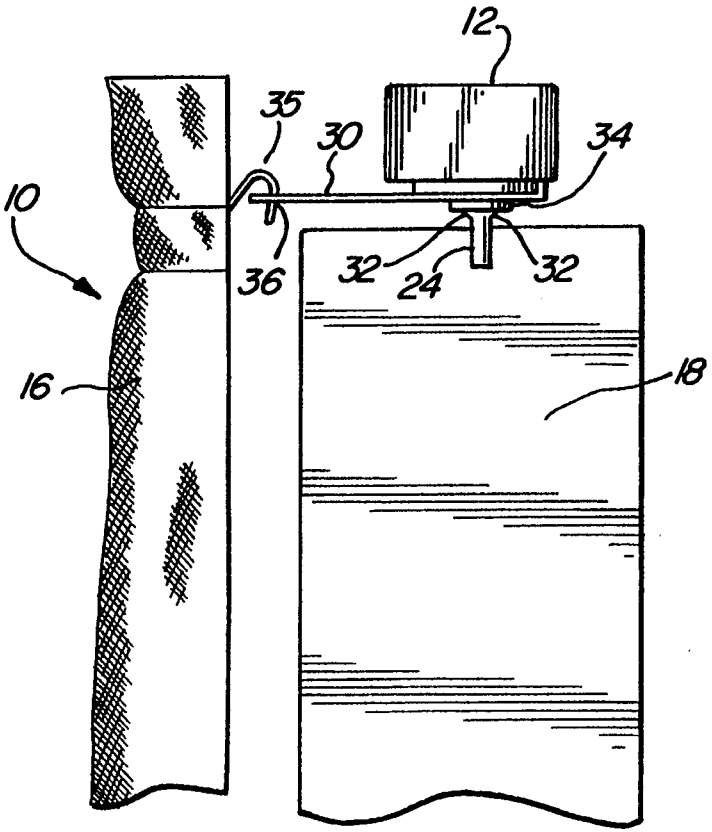
FIG. 2 is a side elevational view taken along line 2—2 of FIG. 1, showing a mechanism by which a curtain is mounted to a vertical blind assembly.
Figure 3:
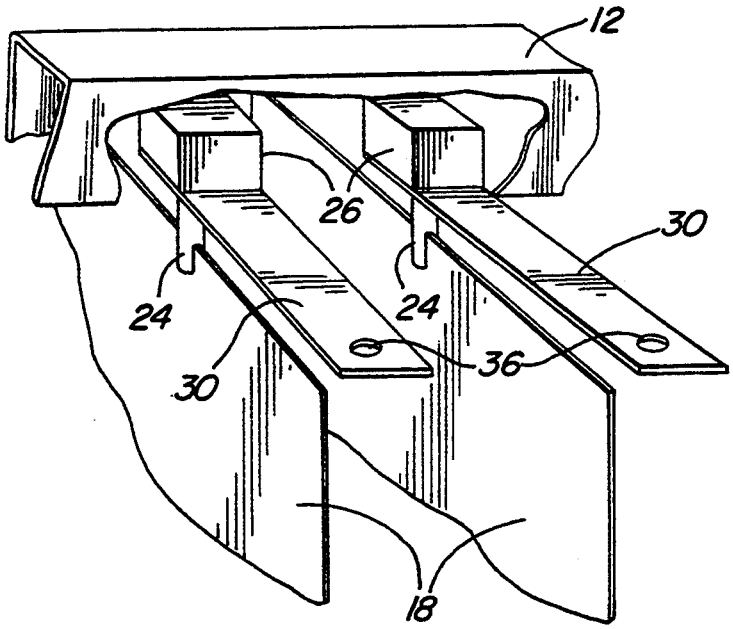
FIG. 3 provides a perspective view, partially in cutaway, of the vertical blind assembly of FIG. 1, illustrating one embodiment of the attachment mechanism wherein, for clarity, the curtain is not illustrated.

Referring to FIG. 2, a mechanism by which curtain 16 is mounted to the vertical blind portion of assembly 10 will now be described. Each individual slat 18 is mounted to housing 12 by a mounting stem 24 which protrudes downwardly through a bottom surface of a carrier 26, which is slidably mounted within housing 12. The configuration of carriers 26 is best seen with reference to FIG. 3 showing, in cutaway, a pair of carriers mounted within housing 12. For clarity in FIG. 3, internal mechanisms provided for laterally moving carriers 26 within housing 12 are not shown. Likewise, internal mechanisms for causing pivoting of stems 24 to thereby pivot slats 18 are likewise not shown in FIG. 3.

A mounting bracket 30, preferably formed of a sturdy, durable metal or plastic, mounts to a bottom surface of carrier 26 and extends outwardly, generally horizontally, from housing 12 as shown. Bracket 30 is a flat bracket preferably having a width about equal to the width of the bottom surface of carrier 26. A bore is formed in one end of bracket 30 to allow stem 24 to extend downwardly through the bracket, allowing the stem to pivot freely. A variety of mounting mechanism may be provided for affixing bracket 30 to carrier 26. For example, as shown, a portion of stem 24 may be flared outwardly, at 32, to retain bracket 30. A washer 34 is provided to help secure bracket 30 to housing 26, while still allowing free pivoting movement of stem 24. Alternatively, bracket 30 may be bolted directly to front or side surfaces of carrier 26, integrally formed with carrier 26 or, if carrier 26 is metal, bracket 30 may be welded or soldered thereto.

Bracket 30 extends horizontally outwardly from housing 12 by a distance greater than at least half of the width of slat 18. Thereby, curtain 16, which is mounted to an outer end of bracket 30, does not interfere with free pivoting movement of slat 18. Again, a wide number of mounting mechanisms may be employed. Preferably, however, a simple hook 30 extends outwardly from a rear surface of curtain 16, where it engages with a small bore or aperture 36 formed in a front portion of bracket 30.

Preferably, each carrier 26 is provided with a bracket 30 such that curtain 16 is supported at a large number of points along its rear surface such that the curtain does not undesirably sag. Of course, if desired, a fewer number of mounting brackets can be provided. For example, only every other carrier may be provided with a mounting bracket.

In use, curtain 16 opens and closes along with lateral movement of slats 14. In other words, a downward pulling movement of the front or rear portions of chain 22 (FIG. 1) causes not only the set of slats 14 to expand or compress laterally, but, because curtain 16 is mounted directly to carriers 26, curtain 16 likewise opens or closes. However, up or down pulling movement of chain 20 merely causes individual slats 18 to pivot without causing any movement of curtain 16. This is achieved because brackets 30, which mount curtain 16 to housing 12, are connected to carriers 16 rather than to stems 18.

Figure 4:
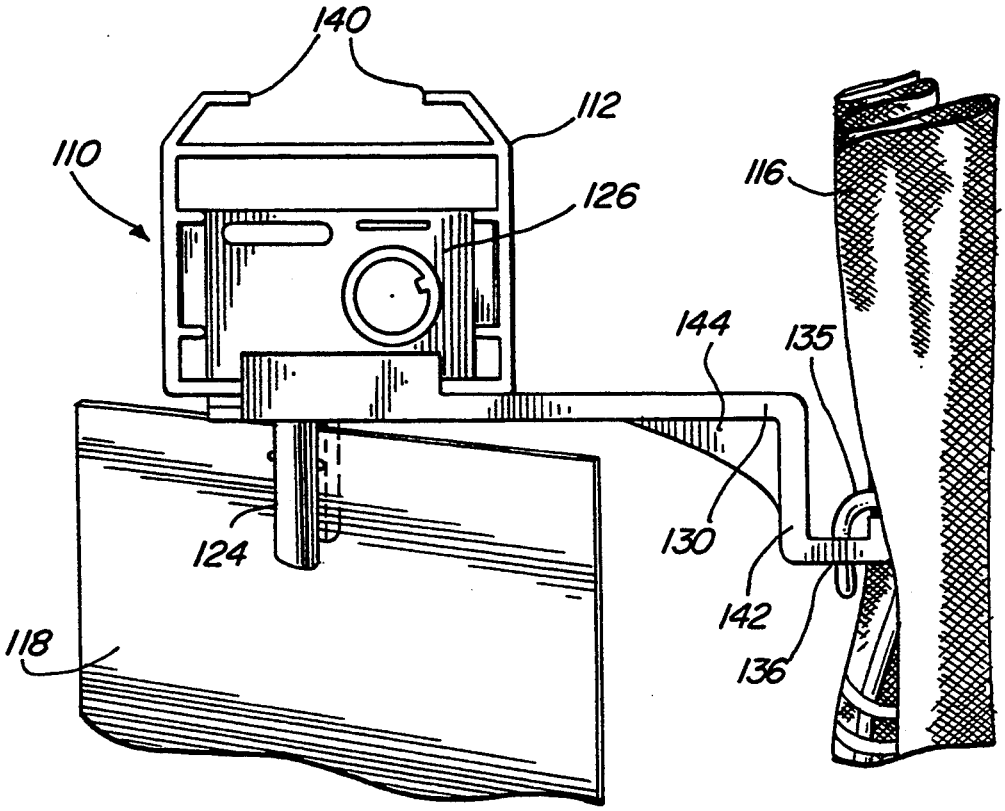
FIG. 4 provides a side cross-sectional view of a combination vertical blind assembly and curtain constructed in accordance with an alternative embodiment of the invention.

Referring to FIG. 4, a first alternative embodiment of the invention of FIGS. 1–3 will now be described. The embodiment of FIG. 4 is similar to that of FIGS. 1–3, and like elements are represented with like reference numerals sequentially beginning at 110. In FIG. 4, a combination vertical blind and curtain assembly 110 is illustrated in cross-sectional view. The assembly includes a housing or head rail 112 similar to the housing of FIGS. 1–3, but including a pair of upwardly-extending angled bracket members 140 which facilitate mounting the assembly to a wall or ceiling adjacent to a window. Mounting bracket 130, which attaches curtain 116 to a carrier 126, includes a downwardly-extending L-shaped portion 142. Hook 135 extends rearwardly from curtain 116 and is received within a bore 136 formed in a bottom horizontal portion of the downwardly-extending L-shaped member 142. Hence, hooks 135 are mounted to bracket 130 at a height below the tops of slats 118. This helps ensure that the curtain does not extend to a height substantially above a top portion of housing 112. This feature is particularly advantageous if the housing 112 is directly mounted to a ceiling, in which case the curtain could not extend substantially above a topmost portion of the housing without contacting the ceiling.

Bracket 130 is preferably constructed of PVC or some other plastic material. A reinforcing portion 144 connects a bottom surface of a top portion of bracket 130 with a rear surface of downwardly-extending L-shaped portion 142 to provide enhanced structural stability and rigidity. A rear portion of bracket 130 mounts to a bottom surface of carrier 126. As shown, a top surface of bracket 130 abuts a bottom surface of housing 112, ensuring enhanced stability and smooth lateral movement. Rear side portions of bracket 130 extend upwardly along side surfaces of carrier 126. Bracket 130 is attached to carrier 126 using any of a number of attachment techniques, including integral molding.

As with the embodiment of FIGS. 1–3, internal mechanisms for laterally moving the carriers and for pivoting the stems are not fully shown.

Figure 5:
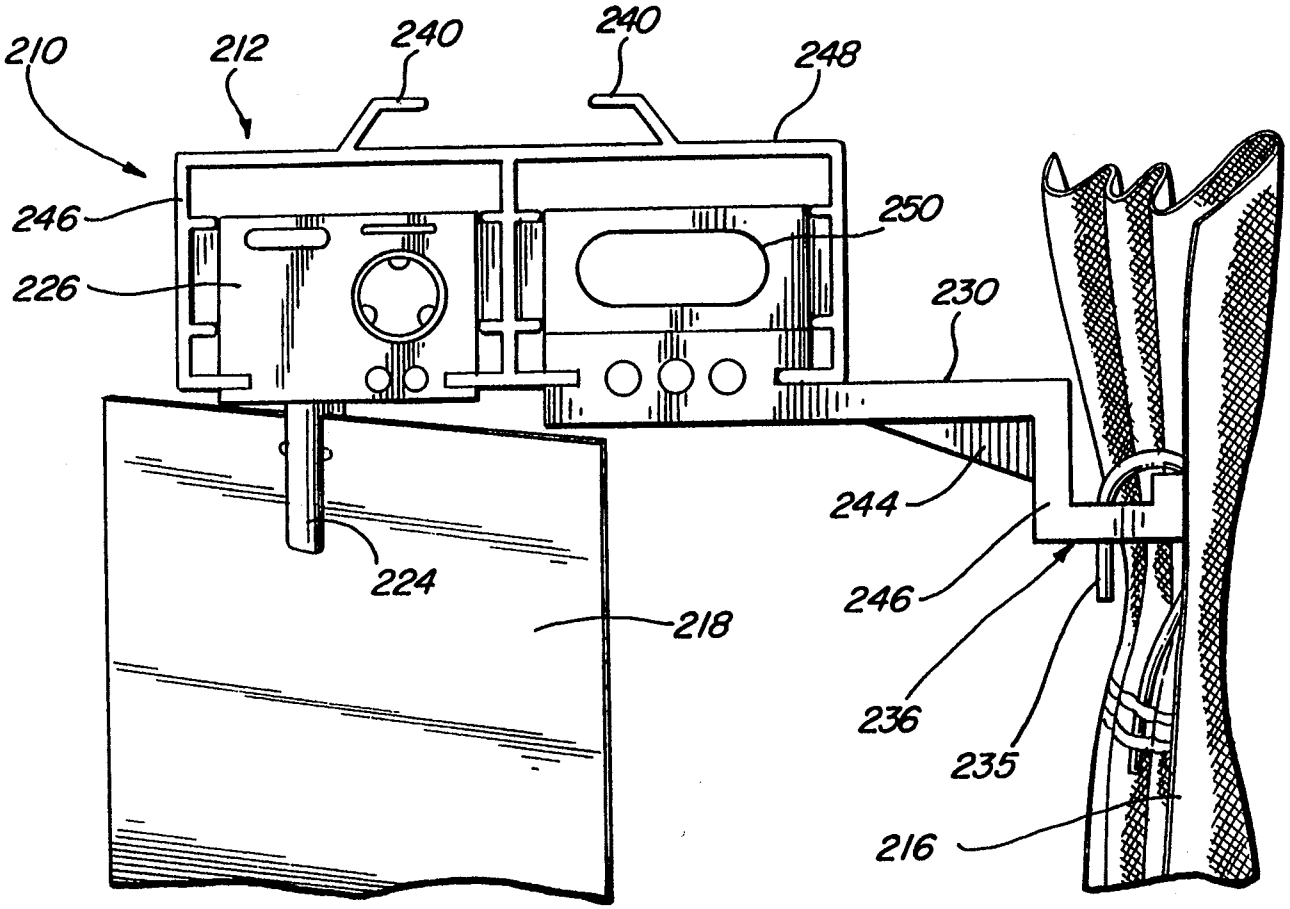
FIG. 5 provides a cross-sectional view of a combination vertical blind assembly and curtain constructed in accordance with a second alternative embodiment, wherein a pair of housings are provided with a set of slats mounted to a first housing and with the curtain mounted to a second housing.

FIG. 5 provides a second alternative embodiment of the invention, wherein a pair of "Siamese" housings are provided. The embodiment of FIG. 5 is similar to that of FIGS. 1–3, and like elements are represented with like reference numerals sequentially beginning at 210. In FIG. 5, a vertical blind assembly 210 is illustrated including a Siamese housing 212 includes a rear housing 246 and a front housing 248. Carriers 226 are slidably mounted within rear housing 246, with slats 218 pivotally mounted to carriers 226 via downwardly-extending stem 224. Curtain 216 is connected via bracket 230 to a second set of carriers 250 slidably mounted within front housing 248. The bracket 230 includes a downwardly-extending L-shaped portion 242. A hook 235 extends rearwardly from curtain 216 and is received within a bore 236 formed in a bottom horizontal portion of the L-shaped portion 242. A reinforcing portion 244 connects a bottom surface of a top portion of bracket 230 with a rear surface of downwardly-extending L-shaped portion 242 to provide enhanced structural stability. The mechanism by which bracket 230 connects to carrier 250 is similar to the previously-described mounting mechanisms, except that no provision need be made for a stem to extend downwardly through bracket 230.

A lateral movement mechanism (not shown) is provided for sliding carriers 250 within front housing 248. This sliding mechanism may be similar to the sliding mechanism employed for moving carriers 226 within rear housing 246. With this Siamese configuration, curtain 216 is openable and closable independently of any movement of slats 218. Hence, slats 218 can be opened entirely, while leaving curtain 216 fully closed, and vice versa. As illustrated in FIG. 5, rear housing 246 and front housing 248 are integrally formed as a single "Siamese" housing. A single set of upwardly-extending mounting brackets 240 are provided. Alternatively, front housing 248 can be a separate housing mounted adjacent to rear housing 246. In such an embodiment, either the front housing, the rear housing, or both, can be provided with mounting brackets for mounting to a ceiling or wall or to each other.

Figure 6:
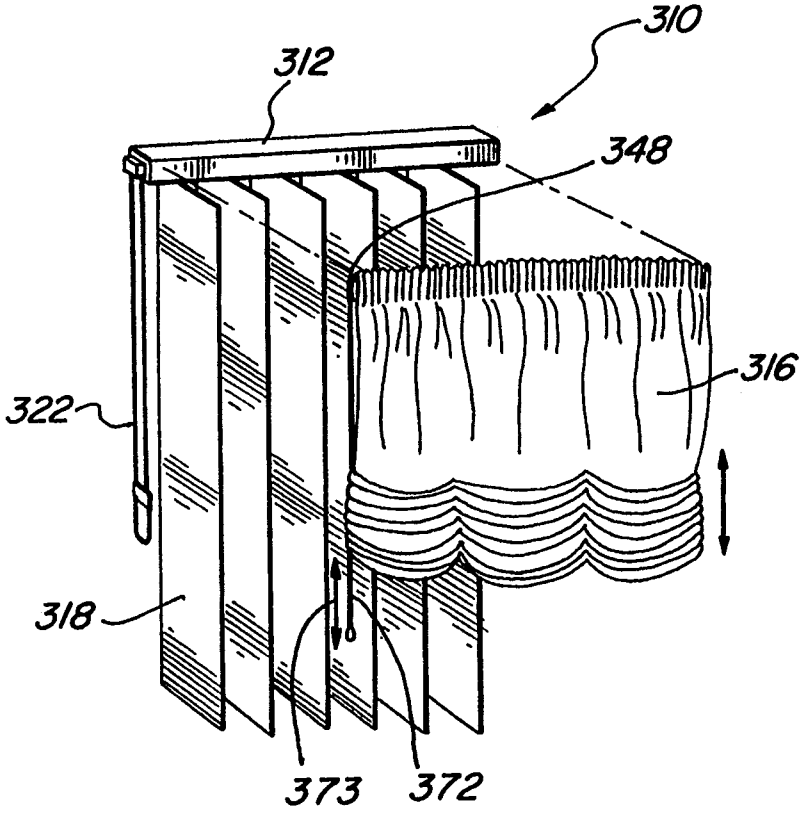
FIG. 6 provides an exploded view of an alternative combination vertical blind assembly and curtain, similar to the embodiment of FIG. 1, but provided with a vertical Austrian curtain.

Referring to FIG. 6, a fourth embodiment of the invention will now be described. Like elements from previously-described embodiments are represented with like reference numerals, sequentially beginning at 310. The embodiment of FIG. 6 provides a vertically-raisable and lowerable curtain 316 mounted to a housing or head rail 312 of a vertical blind assembly. The vertical, or Austrian, curtain includes its own head rail 348 and lift cord 372. Lift cord 372 allows vertical curtain 316 to be raised or lowered, as indicated by arrows 373, by a desired amount using a conventional lift mechanism provided within housing 348. A rear surface of front housing 348 is mounted to a front portion of rear housing 312. However, housing 348 can also be integrally formed with housing 312, in the same manner as set forth in FIG. 5, to provide a Siamese housing. As with the previously-described embodiments, curtain 316 should be positioned sufficiently distant from slats 318 to permit free pivoting and lateral movement of slats 318.

Figure 7:
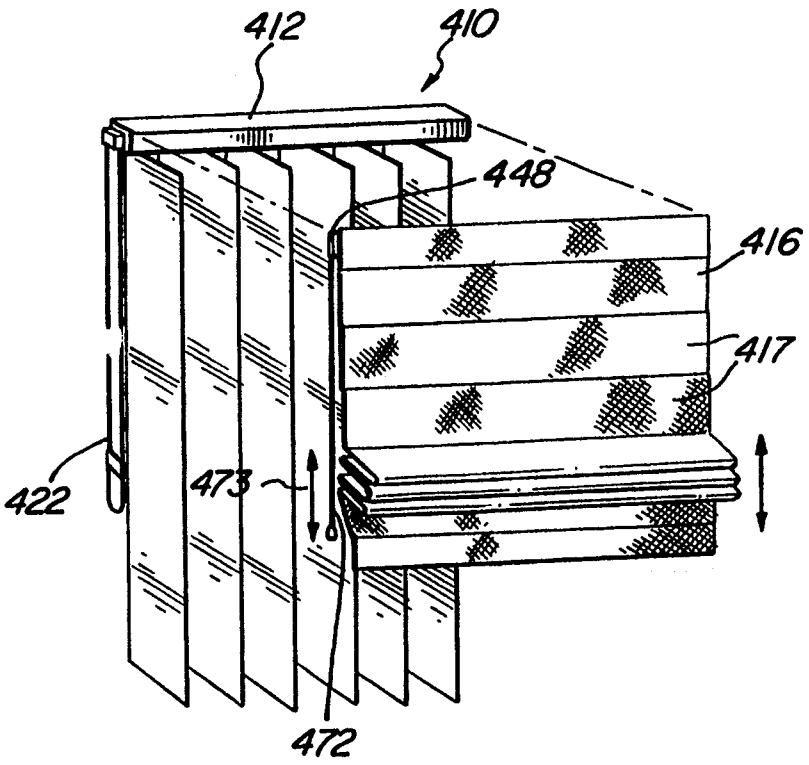
FIG. 7 provides an exploded view of an alternative combination vertical blind assembly and curtain, similar to that of FIG. 6, but provided with a vertical curtain of the type comprised of a plurality of horizontal slats.

FIG. 7 provides an embodiment, similar to that of FIG. 6, but of the type in which a vertical curtain is composed of a plurality of horizontal slats 417, rather than the Austrian curtain of FIG. 6. As with the embodiment of FIG. 6, vertical curtain 416 of FIG. 7 includes its own housing or head rail assembly 448 with lift cord 472. Housing 448 is either mounted to a front surface of vertical blind housing 412 or integrally formed therewith. Alternatively, front housing 448 may be provided with its own mounting brackets for mounting directly to a ceiling or wall, in which case housing 448 is positioned adjacent to rear housing 412. An integrally-formed Siamese housing is preferred, as it provides a single, sturdy housing. As with previous embodiments, vertical curtain 416 is spaced outwardly from vertical slats 418 by a sufficient amount to avoid interfering with the pivoting or lateral movement of slats 418.

Although shown and described with reference to several particular vertical blind configurations, the principles of the invention can be employed with any of a wide variety of vertical blinds. Further, although shown and described with respect to particular mounting mechanisms for mounting the curtain to the vertical blind, any of a number of alternative mounting mechanisms can be employed as well. The mounting mechanisms described thus far are preferred, since these mechanisms provide a simple, inexpensive, and durable mechanism for mounting the curtain to vertical blind assembly, and because pivoting movement of individual slats is not hindered. Further, in the first embodiment, by mounting the curtain directly to the laterally movable carriers, a single tug of the lateral movement cord 22 causes both the curtain and the set of slats to retract or expand equally. Hence, an additional movement mechanism for opening or closing the curtains is not needed. No substantial modification to the vertical blind assembly is required other than the mounting of mounting brackets 30 to carriers 26. The embodiments of FIGS. 5–7, which set forth a curtain which is not mounted directly to the corners of the vertical slats, have the advantage that the curtain can be adjusted entirely independently of the vertical slats.

The provision of a curtain, particularly a somewhat translucent curtain, allows for flexibility and control over the amount of light entering a room. The vertical blinds can be opened to allow a considerable amount of light, while still maintaining privacy by keeping the curtains closed. Further, with a closed curtain positioned in front of open vertical blinds, the possibly stark high-contrast illumination caused by direct sunlight coming through the blinds is diffused.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A window covering assembly comprising:

a housing having first and second parallel adjacent channels;

a plurality of vertical blind slats;

a set of first carriers mounted within the first channel for lateral movement therein, each first carrier having a stem pivotally supporting one of said plurality of vertical blind slats;

a set of second carriers mounted within the second channel for lateral movement therein;

a curtain;

a plurality of curtain brackets, each curtain bracket attached to a bottom of one of said second carriers, each curtain bracket extending horizontally outwardly away from the first channel to a distal end;

means for attaching the curtain to the distal end of each curtain bracket, the vertical slats mounted to said first carriers pivoting freely between the stem and the distal ends of each curtain bracket beneath the second carriers;

means for moving at least a portion of said curtain by moving the second set of carriers independent of any movement of said vertical slats; and means for mounting the housing to a surface of an existing structure.

2. The window covering assembly of claim 1 wherein said second channel is integrally formed with said first channel.

3. The window covering assembly of claim 1, wherein said means for attaching the curtain comprises:

an aperture located at the distal end of the curtain bracket.

4. The window covering assembly of claim 1 wherein the mounting means comprises a single pair of opposing upwardly-extending angled brackets.

5. A window covering assembly comprising:

a curtain;

vertical slats;

a plurality of first carriers;

means in each first carrier for pivotally holding a vertical slat;

a plurality of second carriers;

a housing having first and second parallel adjacent channels, said first carriers slidably mounted in the first channel and said second carriers slidably mounted in the second channel, said first channel being separated from the second channel so that an upper outward end of a pivoting vertical slat may interface with one of said second carriers;

a plurality of curtain brackets, each curtain bracket attached to a bottom of one of said second carriers, each curtain bracket extending horizontally outward away from the first channel to a distal end;

means for attaching the curtain to the distal end of each curtain bracket, the vertical slats mounted to said first carriers pivoting freely beneath the second carriers; and means for mounting said housing to a surface of an existing structure.

6. The window covering assembly of claim 5 wherein the first and second channels are integrally connected.

7. The window covering assembly of claim 5 wherein the mounting means comprises a single pair of opposing upwardly-extending angled brackets.

8. The window covering assembly of claim 5 wherein the means for pivotally holding a vertical slat includes a mounting stem protruding downwardly from a bottom surface of each first carrier.

9. A window covering assembly comprising:

a housing having first and second parallel adjacent channels, separated by a predetermined distance;

a plurality of first carriers slidably mounted within the first channel for horizontal movement therein;

a plurality of second carriers slidably mounted within the second channel for horizontal movement therein;

a pivotal mounting stem protruding vertically downwardly from a bottom surface of each first carrier for pivotally supporting a vertical-slat; and a substantially horizontal curtain bracket attached to a bottom of each second carrier and having an aperture at a distal end, said bracket extending outwardly away from the first channel to allow the vertical slats supported by said first carrier to pivot freely beneath a portion of said second carriers.

10. A window covering assembly comprising:

a plurality of vertical blind slats;

a curtain;

a first plurality of carriers pivotally supporting said plurality of vertical blind slats from a top end thereof;

a second plurality of carriers for supporting said curtain;

first and second parallel adjacent channels respectively supporting said first and second plurality of carriers, said first and second parallel adjacent channels separated from one another by a small distance which requires that the top ends of the pivotally supported vertical blind slats pivot beneath the second plurality of carriers; and a plurality of curtain brackets, each curtain bracket attached to one of said second plurality of carriers, each curtain bracket extending horizontally away from both of said first and second carriers to a distal end supporting said curtain, each curtain bracket of sufficient length that the top ends of the pivotally supported vertical blind slat may pivot beneath the second plurality of carriers supporting said curtain notwithstanding the small distance separating the first and second channels.

* * * * *